US009934739B2

(12) United States Patent
Hogan

(10) Patent No.: US 9,934,739 B2
(45) Date of Patent: Apr. 3, 2018

(54) LOW POWER SYMBOLOGY GENERATOR AND DISPLAY DRIVER

(71) Applicant: Kopin Corporation, Westborough, MA (US)

(72) Inventor: Timothy Brandon Hogan, Allen, TX (US)

(73) Assignee: Kopin Corporation, Westborough, MA (US)

( * ) Notice: Subject to any disclaimer, the term of this patent is extended or adjusted under 35 U.S.C. 154(b) by 250 days.

(21) Appl. No.: 14/956,820

(22) Filed: Dec. 2, 2015

(65) Prior Publication Data

US 2016/0163275 A1 Jun. 9, 2016

Related U.S. Application Data

(60) Provisional application No. 62/087,217, filed on Dec. 3, 2014.

(51) Int. Cl.
*G09G 3/36* (2006.01)
*G09G 5/39* (2006.01)

(52) U.S. Cl.
CPC ..... *G09G 3/3648* (2013.01); *G09G 5/39* (2013.01); *G09G 2330/021* (2013.01); *G09G 2340/12* (2013.01); *G09G 2352/00* (2013.01); *G09G 2360/18* (2013.01)

(58) Field of Classification Search
CPC .. G09G 3/3648; G09G 5/39; G09G 2330/021; G09G 2360/18; G09G 2352/00; G09G 2340/12
See application file for complete search history.

(56) References Cited

U.S. PATENT DOCUMENTS 4,868,652 A * 9/1989 Nutton ..... H04N 3/09 250/334
5,150,117 A * 9/1992 Hamilton ..... F41G 3/225 340/946
5,668,500 A * 9/1997 LeFevre ..... H03F 3/45183 250/330
7,928,862 B1 * 4/2011 Matthews ..... G01C 23/00 244/17.11
2016/0341543 A1 * 11/2016 Jancic ..... G01B 11/026

* cited by examiner

*Primary Examiner* — Maurice L McDowell, Jr.
(74) *Attorney, Agent, or Firm* — Hamilton, Brook, Smith & Reynolds, P.C.

(57) ABSTRACT

A display driver includes a symbology generator having an electronic architecture optimized for symbology display, along with an interface to a microdisplay. The interface is configured to operatively couple the symbology generator to the microdisplay, to support a display of symbol objects on the microdisplay. The symbology generator may be a one-bit symbology generator configured to provide bi-level pixel data representing symbology to the microdisplay. The symbology generator may be configured to provide video information to the microdisplay in addition to the bi-level pixel data. The symbology generator may be further configured to coordinate the bi-level pixel data with the video information. The coordination may include various types of blending of the symbology data and the video data, or a hybrid mode where symbology data is applied to one set of pixels of the microdisplay, and video data is applied to another set of pixels of the microdisplay.

20 Claims, 4 Drawing Sheets

LOW POWER SYMBOLOGY GENERATOR AND DISPLAY DRIVER

RELATED APPLICATION

This application is a claims the benefit of U.S. Provisional Application No. 62/087,217, filed on Dec. 3, 2014. The entire teachings of the above applications are incorporated herein by reference.

BACKGROUND OF THE INVENTION

Symbology display systems allow for various symbols to be overlaid (i.e., superimposed) on a primary display image. Examples of direct view applications that may use symbology display systems include automotive head-up displays, avionics head-up displays, consumer eyewear products, medical microscope systems, and weapon sight systems, among others.

Electronic symbology display systems often require a substantial amount of power to operate. Further, such symbology display systems may be quite large, and have significant interface complexity. The power, size and/or interface complexity of such systems may limit their feasibility for use in certain applications.

SUMMARY OF THE INVENTION

The described embodiments provide a symbol generator and one or more display drivers that overcome the limitations of prior symbology display systems. Embodiments implement symbology images that may be displayed alone or as an overlay to a primary display. The embodiments may be used in associate with direct view applications such as automotive head-up displays, avionics head-up displays, consumer eyewear products, medical microscope systems, and weapon sight systems, among others.

In one aspect, the described embodiments provide a display driver comprising a symbology generator having an electronic architecture optimized for symbology display, along with an interface to a microdisplay. The interface is configured to operatively couple the symbology generator to the microdisplay, to support a display of symbol objects on the microdisplay. The display driver may be physically separate from the microdisplay, or the display driver may be integrated with the microdisplay.

In one embodiment, the symbology generator is a one-bit symbology generator configured to provide bi-level pixel data to the microdisplay. In another embodiment, the symbology generator is configured to provide video information to the microdisplay in addition to the bi-level pixel data. In another embodiment the symbology generator is further configured to coordinate the bi-level pixel data with the video information. The video information may be derived from external video information provided by a video source external to the display driver. The symbology generator may be configured to continue providing bi-level pixel data to the microdisplay when the video source discontinues providing external video information.

In an embodiment, the symbology generator is further configured to blend the bi-level data with the video information according to one or more of opaque symbology blending, translucent symbology blending, and exclusive-OR blending.

In another embodiment, the interface to the microdisplay includes a one-bit symbology driver. In another embodiment, the symbology generator receives at least one of icon data, configuration data and shape parameters from one or more sources external to the display driver.

In one embodiment, the symbology generator includes one or more of an address realignment module, a graphic processor, a bit-memory access module, a caching module and a cache. The graphic processor may be configured to render display objects based on one or more parameters. The parameterized display objects may include one or more of lines, ellipses, circles, wedges and polygons.

In an embodiment, the display driver is powered by a single-voltage power source. The symbology generator may be configured to operate in a hybrid mode. In the hybrid mode, a first set of microdisplay pixels may be dedicated to symbology and a second set of pixels may be dedicated to video.

In another aspect, the described embodiments provide a display driver comprising a microcontroller configured to receive, store and process symbol information and configuration information, and a one-bit symbology generator configured to accept the symbol information and configuration information, and produce therefrom a one-bit symbology stream. The symbology stream may be data to be scanned to a microdisplay, one bit per pixel.

One embodiment further includes an interface to the microdisplay. The interface may be configured to operatively couple the one bit symbology generator to the microdisplay. The symbology generator may include a bit memory access module configured to set or clear a bit in a frame buffer within a single clock cycle. The symbology generator may include a caching module configured to accomplish a read from a cache or write to the cache. The symbology generator may include an address realignment module configured to accomplish a multiple-bit write of symbology information to a frame buffer memory. The symbology generator may maintain an active set of symbology data in a frame buffer, and the symbology generator may repeatedly scan the symbology data from the frame buffer to the microdisplay.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The teachings of all patents, published applications and references cited herein are incorporated by reference in their entirety.

The described embodiments include a Low Power Symbology Generator (LPSG) that incorporates an electronic architecture optimized for symbology display. One benefit of this architecture is a reduction in operating power as compared to other architectures, which makes the described embodiments compatible with portable (i.e., battery operated) display systems.

Figure 1:
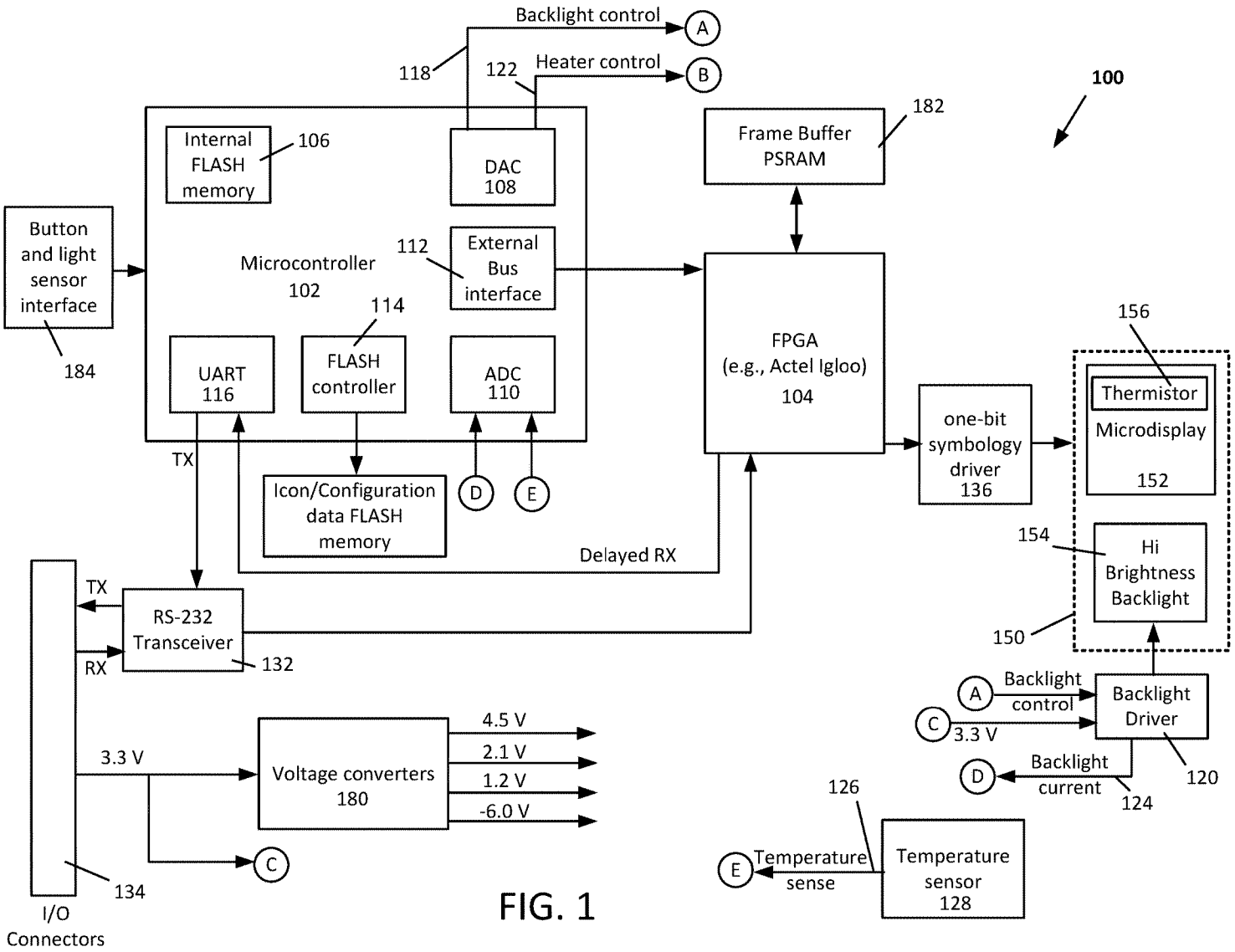
FIG. 1 is a schematic view of an embodiment of the present invention.

FIG. 1 illustrates one embodiment of the invention, an LPSG 100. This embodiment includes a microcontroller 102 and a field-programmable gate array (FPGA) 104. In one embodiment, an "Actel Igloo" FPGA is used as the FPGA 104, although other types and makes of FPGA may be alternatively used. Further, some or all of the functionality of the FPGA 104 may be implemented by other hardware elements, for example by an application-specific integrated circuit (ASIC) or by a collection of discrete electrical components.

The microcontroller 102 includes internal flash memory 106, a digital to analog converter (DAC) 108, an analog to digital converter (ADC) 110, an external bus interface 112, an external flash memory controller 114, and a universal asynchronous receiver/transmitter (UART) 116.

The DAC 108, among other functions, provides a backlight control signal 118 to a backlight driver 120, and provides a heater control signal 122 to a display heater (not shown).

The ADC 110 receives a backlight current signal 124 from the backlight driver 120, and a temperature sense signal 126 from a temperature sensor 128.

The microcontroller 102 further includes a processing element (not shown; referred to herein as microcontroller unit or MCU) that uses information received by other elements of the microcontroller 102 (e.g., information such as the temperature sense 126 and the backlight current 124 described above) to perform analyses, make decisions and initiate control signals for controlling other portions of the LPSG 100. Although the described embodiment refers to a microcontroller element 102, alternative embodiments may utilize other processing elements such as microprocessors, multiple core processors, for example, may also be used.

The embodiment further includes an external flash memory 130 for use by the microprocessor 102 through the flash controller 114. Although the external memory 130 and the internal memory 106 are described as flash memory in the described embodiments, other types of non-volatile memory known in the art may also be used.

The UART 116 conveys information (e.g., data from the FPGA 104) through a transceiver element 132 to devices and entities external to the LPSG 100. In the described embodiment, the transceiver is an RS-232 transceiver, although the transceiver 132 may implement alternative serial communications protocols known in the art. The UART 116 may receive serial data from the transceiver 132, either directly (not shown), or through the FPGA 104.

The transceiver element 132 is electrically coupled to an I/O connector 134 that provides an interface to devices and entities external to the LPSG 100. The I/O connector conveys a serial transmission (TX) data signal from the transceiver 132, and conveys a serial input (RX) data signal to the transceiver 132. The transceiver 132 provides serial data received at the I/O connector 134 to the FPGA 104. The transceiver 132 and the I/O connector 134 may be referred to herein as the serial port.

Figure 3:
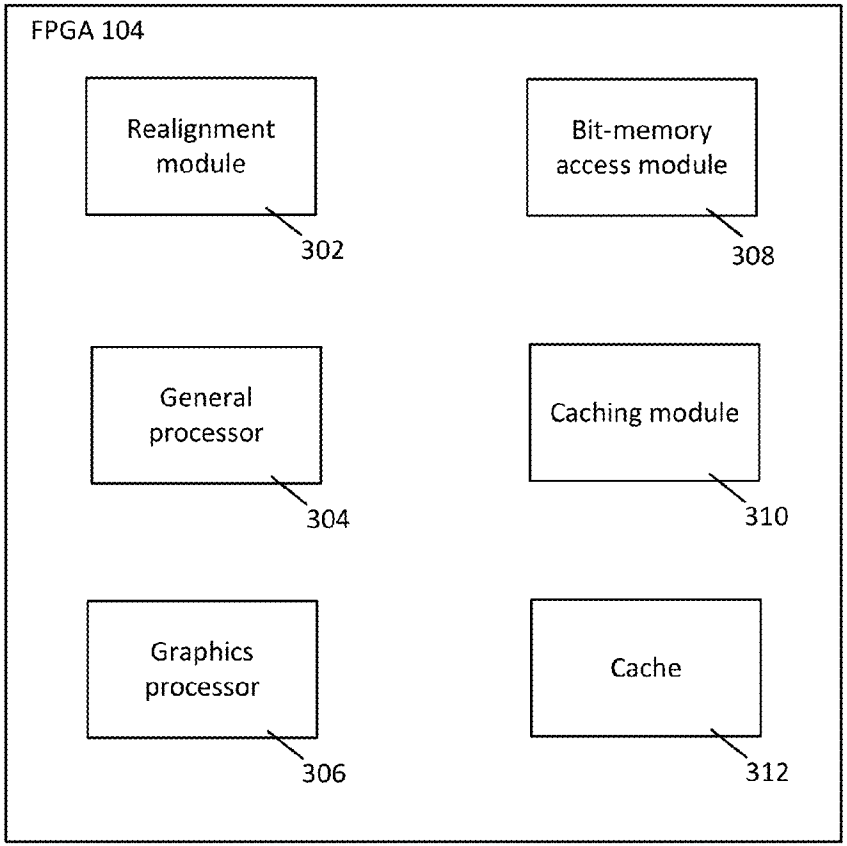
FIG. 3 is a schematic view of the FPGA shown in FIG. 1.

In the described embodiments, the LPSG 100 provides symbology information to a microdisplay module 150. The symbology information is one-bit information provided by a one-bit symbology generator implemented by the FPGA 104, and driven by the one-bit symbology driver 136. The one-bit symbology generator may receive icon data (i.e., data representing an icon or symbol) and configuration data from one or more external sources, through the serial port, along with information and control data from the microcontroller 102, to generate the one-bit symbology information that the one-bit symbology generator provides to a symbology driver 136. The one-bit symbology generator may consist of one or more of an address realignment module 302, a general processor 304, a graphic processor 306, a bit-memory access module 308, a caching module 310 and a cache 312, as illustrated in FIG. 3. The general processor 304 may include a particular processing element, a distributed processing and/or coordinating functionality, or both.

In the described embodiments, the microdisplay module 150 includes a microdisplay element 152 and a backlight element 154. As shown in the example embodiment of FIG. 1, the microdisplay module 150 may be separate from, but electrically coupled to, the LPSG 100. In other embodiments, one or more components o the LPSG 100 may be integrated with the microdisplay module, or to the microdisplay element 152 itself.

The microdisplay element 152 may have associated with it a thermistor 156 for monitoring the temperature of the microdisplay element 152. A signal from the thermistor (not shown) may be used by the microcontroller 102, alone or in conjunction with the temperature sense 126, to adjust the heater control signal 122 or provide another control signal for controlling the temperature of the LPSG 100 and /or the microdisplay element 152.

Figure 2:
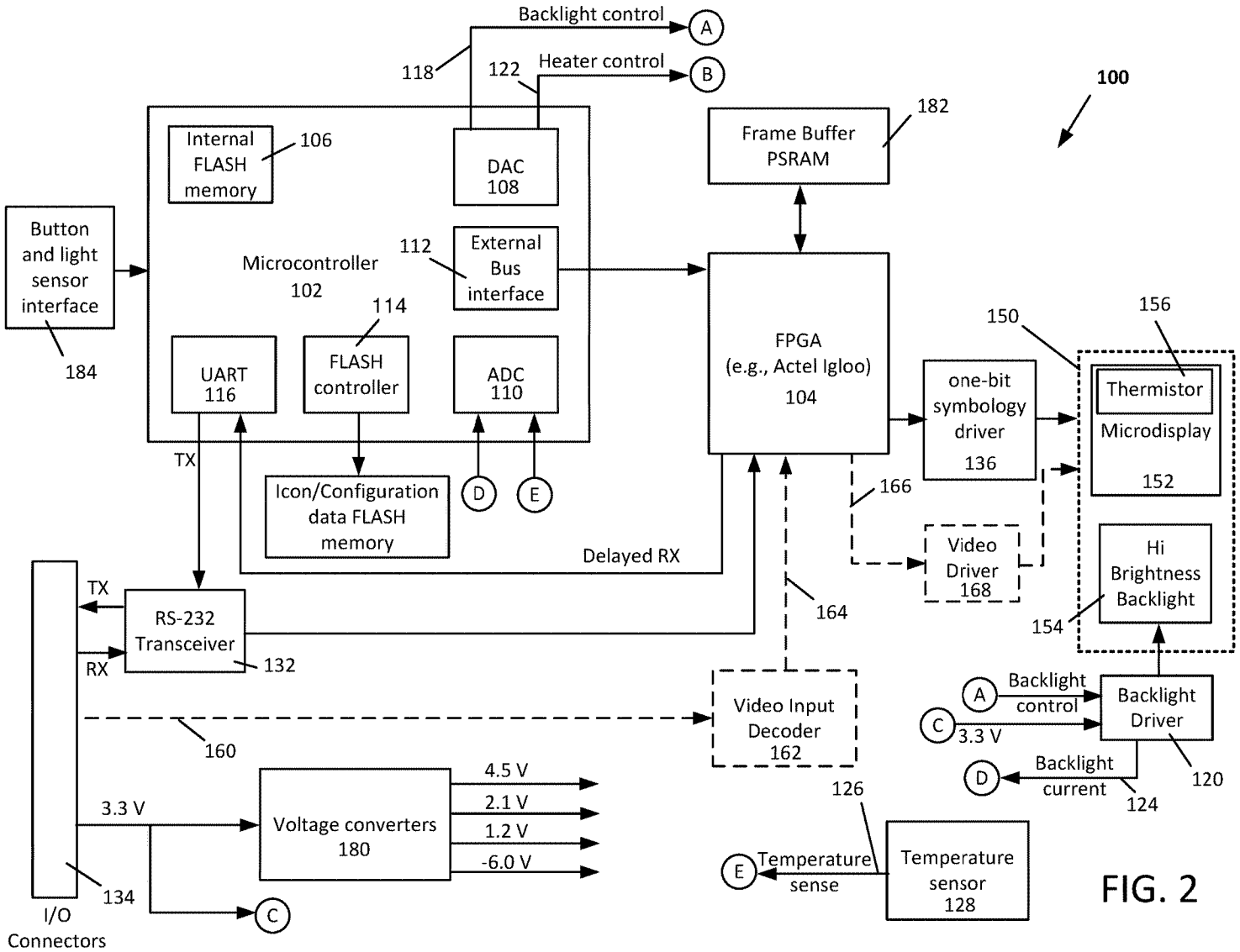
FIG. 2 is a schematic view of the embodiment of FIG. 1, further including video input components.

In some embodiments, the LPSG 100 may receive a video signal 160 with a video input decoder 162, which provides a decoded video signal 164 to the FPGA 104, shown in FIG. 2. The video data may represent a still video image or a moving video image, and may include one or more bit-per-pixel data. The FPGA 104 may coordinate the decoded video signal 164 with the one-bit symbology information provided to the symbology driver 136, and provide a processed video signal 166 to a video driver 168. The video driver 168 provides a driven video signal 170 to the microdisplay 152. In this way, the one-bit symbology information may be overlaid upon the video information displayed on the microdisplay 152.

The LPSG 100 further includes a voltage regulator module 180 that converts a single input voltage (3.3 V in this example embodiment, although other input voltages may also be used) into one or more voltages for use within the LPSG 100. Thus, the described embodiments may operate from a single-voltage power source. In this example, the converted voltages include 4.5 volts, 2.1 volts, 1.2 volts and −6.0 volts, although the voltage regulator module 180 may be configured to produce more or other voltages for use by the LPSG 100.

The FPGA 104 has access to a pseudo-static random-access memory (PSRAM) 182, or other memory device having similar operational characteristics, for use as a frame buffer. Details regarding the frame buffer PSRAM 182 are presented in the sections below.

As described above and illustrated in FIG. 1, the system supports optional video input and display. In the described embodiments, the video can be blended with the symbology information, and shown with the symbology on the microdisplay 152. For example, the video may be overlayed, scaled, shifted, or warped as needed. The LPSG 100 is powered by a single power supply and controlled through a UART and/or an RS-232 (or other serial) interface.

Figure 4:
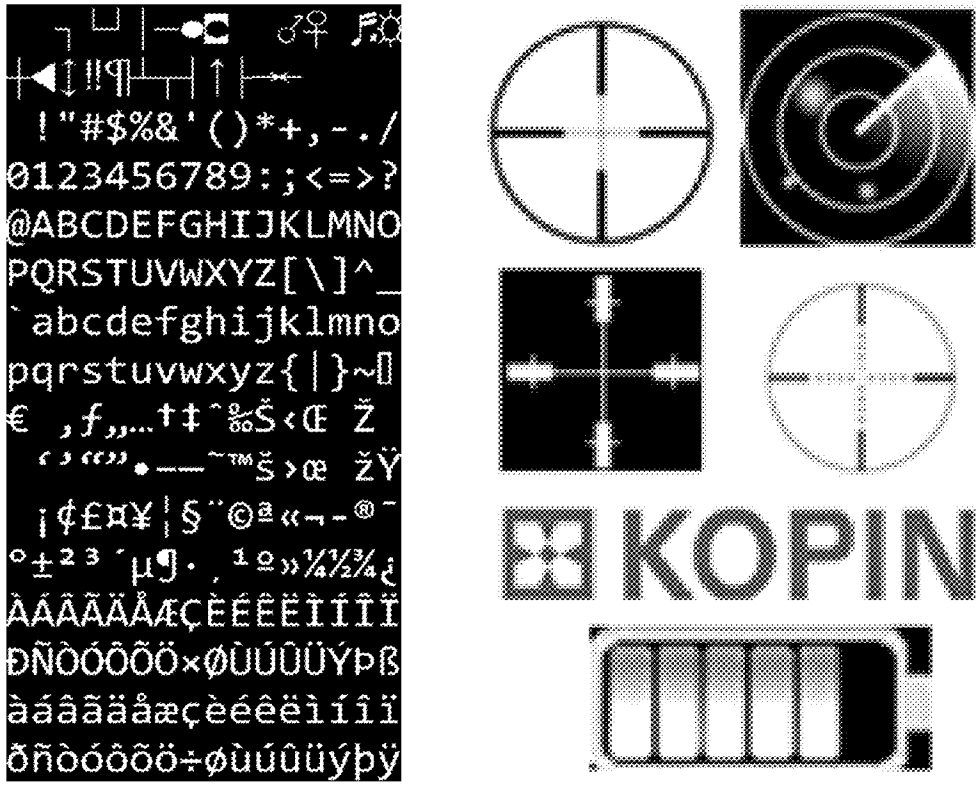
FIG. 4 is a perspective view of symbol graphics output by the embodiment of FIG. 1.

The LPSG 100 supports drawing of bitmapped images, text, and/or parameterized shapes using bi-level pixel data. FIG. 4 shows examples of the types of symbology that may be displayed using the described embodiments.

Regarding bitmaps and text, an external utility application (i.e., external to the LPSG 100, such as a PC-based utility) may be used to convert various fonts (e.g., Windows-based fonts or other source fonts; any sized fonts) or bitmapped images to a 1-bit format suitable for use by the LPSG 100. The resulting file may be transmitted to the LPSG 100 through the serial transceiver 132 (referred to herein as the serial link) and stored in flash memory 130. Any number of ASCII characters and icons can thus be presented simultaneously and at any location on the microdisplay 152. The FPGA 104 implements an address re-alignment module 302 that allows the MCU to copy 16 pixels of text or image to the microdisplay 152 per clock cycle, regardless of whether the target display address is aligned to a 16-bit boundary.

Regarding parameterized (i.e., vector drawn) shapes, the graphics processor 306 can render multiple types of parameterized shapes in real time, including lines, ellipses, circles, pie wedges, and polygons, based on parameters received through the serial link and/or parameters provided by the microcontroller 102. Shapes can be drawn with any specified line thickness (specified through the parameters) or may be completely filled. The graphics processor 306 may maintain a table of previously drawn shape objects, allowing the graphics processor 306 to quickly erase and update each shape in real time when updated parameters are received over the serial link.

The LPSG 100 may support video input, which may be turned on and off while the LPSG 100 maintains full symbology operation. In other words, the LPSG 100 may provide a symbology layer on the display with or without an underlying video image. When video capability is disabled, the power requirements are substantially reduced. For example, some embodiments require less than 1 mW of power when video capability is disabled. The described embodiment supports multiple video/symbology blending options, such as opaque symbology blending, translucent symbology blending, and exclusive-OR symbology blending, among others.

One or more embodiments may operate in a hybrid video/symbology mode, in order to save power while retaining video display. In a hybrid video/symbology mode, some display pixels are dedicated to symbology and others to video. On a color display for example, one or two of the three subpixels may be allocated to symbology, and the rest to video. On a monochrome display for example, either odd or even columns may be allocated to symbology and the rest to video. Video bandwidth and power are reduced proportionally to the number of pixels actually displaying video information. This architecture takes unique advantage of the active-matrix liquid crystal display (AMLCD) design, in which horizontally adjacent pixels are driven by different inputs.

This hybrid mode operation capability allow the described embodiments to support monochrome, multi-color, and full-color displays, including displays with custom color sub-pixel configurations.

The described embodiments support multiple types of video-to-display synchronization. For input video frame rates which match the desired display frame rate, the LPSG 100 can phase lock the display to the video input and support minimum video latency with little to no image tearing, using one or no frame buffers.

For other video frame rates (i.e., video frame rates that do not match the desired display frame rate), the LPSG 100 can double-buffer the input video, so that the latest video information can be displayed at the desired frame rate, with little or no tearing.

The described embodiments support a variety of display resolutions, for example from 640×480 monochrome to 1280×1024 color. Further, the described embodiments are scalable to support resolutions within or beyond this range.

The LPSG 100 may support both portrait and landscape display orientations, and all possible combinations of 90° rotations and horizontal/vertical mirroring. In some embodiments, video and symbology orientation controls are independent, allowing, for example, operation with an image sensor that must be mounted upside-down relative to the display.

Embodiments of the LPSG 100 may implement several features of the FPGA 104 to accelerate image rendering. A bit-memory access module 308 allows the MCU to set or clear a single bit in the frame buffer in a single clock cycle, without a read-modify-write process. The FPGA 104 implements a hardware-based caching module 310 to accomplish single clock read/writes for addresses in the cache 312. An address realignment module 302 allows the MCU to write 16 bits at a time to any location in the frame buffer memory, not just 16-bit aligned addresses. These features together allow for pixel rendering rates in excess of one million pixels per second.

In some embodiments, a power reduction may be achieved by minimizing data transfer between the host system and LPSG. Symbology parameters are received by the LPSG 100 over a two-wire serial interface 132. Both the host and LPSG microprocessor units (MPU) can be idle when symbology is not changing. The current (active) symbology is maintained in a low power PSRAM frame buffer 182, and the FPGA 104 continuously scans the contents of the frame buffer 182 to the microdisplay 152.

The LPSG 100 implements a "1-bit" (i.e., bi-level) symbology architecture, which may eliminate the digital-to-analog conversions associated with other display applications. Graphics are stored in 1-bit format in both flash memory 130 and the frame buffer 182, reducing memory bandwidth by allowing transfer of 16 pixels per clock cycle. In some embodiments, information provided for each pixel of the microdisplay is in the form of a single binary (i.e., bi-level) data unit (i.e., a bit).

The LPSG MCU uses direct memory access (DMA) capability to transfer symbology data from external flash memory (or an internal buffer) to the symbology frame buffer 182, largely without MCU intervention. Alternatively, the DMA transfer may be accomplished by the general processor 304 of the FPGA 104.

When video functionality is selected, a separate parallel video processing path, shown in FIG. 2, is activated while symbology continues to be processed using the 1-bit path.

Embodiments of the invention may implement one or more features to minimize the need for external control and reduce system power consumption. For example, an embodiment may create two or more symbology layers on the microdisplay 152, to manage overlapping of symbology objects. An embodiment may implement synchronized double buffering of video and/or symbology information to make draw/erase operations appear simultaneous or nearly so. In another embodiment, a high brightness backlight controller with automatic temperature and lifetime compensation, and a high (e.g., one million to one) dynamic range. Another embodiment may implement ambient light and proximity sensor interface and automatic brightness control. Another embodiment may support pushbutton or other user inputs, each with configurable behavior. FIG. 1 illustrates such a pushbutton and/or light sensor interface 184.

For some embodiments, the serial port interface 132 may support multiple protocol standards suitable for existing laser range finders and ballistic computers, allowing the LPSG 100 to plug directly into fielded hardware and display the received data.

For some embodiments, two additional serial interface modes may be implemented. In a basic mode, the host system sends the data to be displayed, and the LPSG 100 displays the data in a pre-configured format and location. In advanced mode, the host system explicitly commands the location of each graphics object.

It will be apparent that one or more embodiments described herein may be implemented in many different forms of software and hardware. Software code and/or specialized hardware used to implement embodiments described herein is not limiting of the embodiments of the invention described herein. Thus, the operation and behavior of embodiments are described without reference to specific software code and/or specialized hardware—it being understood that one would be able to design software and/or hardware to implement the embodiments based on the description herein.

Further, certain embodiments of the example embodiments described herein may be implemented as logic that performs one or more functions. This logic may be hardware-based, software-based, or a combination of hardware-based and software-based. Some or all of the logic may be stored on one or more tangible, non-transitory, computer-readable storage media and may include computer-executable instructions that may be executed by a controller or processor. The computer-executable instructions may include instructions that implement one or more embodiments of the invention. The tangible, non-transitory, computer-readable storage media may be volatile or non-volatile and may include, for example, flash memories, dynamic memories, removable disks, and non-removable disks.

While this invention has been particularly shown and described with references to example embodiments thereof, it will be understood by those skilled in the art that various changes in form and details may be made therein without departing from the scope of the invention encompassed by the appended claims.

What is claimed is:

1. A display driver comprising:

a symbology generator having an electronic architecture optimized for symbology display; and an interface to a microdisplay, the interface being configured to operatively couple the symbology generator to the microdisplay to support a display of symbol objects on the microdisplay.

2. The display driver of claim 1, wherein the symbology generator is a one-bit symbology generator configured to provide bi-level pixel data to the microdisplay.

3. The display driver of claim 2, wherein the symbology generator is configured to provide video information to the microdisplay in addition to the bi-level pixel data.

4. The display driver of claim 3, wherein the symbology generator is further configured to coordinate the bi-level pixel data with the video information.

5. The display driver of claim 3, wherein the video information is derived from external video information provided by a video source external to the display driver.

6. The display driver of claim 5, wherein the symbology generator is configured to continue providing bi-level pixel data to the microdisplay when the video source discontinues providing external video information.

7. The display driver of claim 3, wherein the symbology generator is further configured to blend the bi-level data with the video information according to one or more of opaque symbology blending, translucent symbology blending, and exclusive-OR blending.

8. The display driver of claim 1, wherein the interface to the microdisplay includes a one-bit symbology driver.

9. The display driver of claim 1, wherein the symbology generator receives at least one of icon data, configuration data and shape parameters from one or more sources external to the display driver.

10. The display driver of claim 9, wherein the graphic processor is configured to render display objects based on one or more parameters.

11. The display driver of claim 1, wherein the symbology generator includes one or more of an address realignment module, a graphic processor, a bit-memory access module, a caching module and a cache.

12. The display driver of claim 11, wherein the parameterized display objects include one or more of lines, ellipses, circles, wedges and polygons.

13. The display driver of claim 1, wherein the display driver is powered by a single-voltage power source.

14. The display driver of claim 1, wherein the symbology generator is configured to operate in a hybrid mode, where a first set of microdisplay pixels are dedicated to symbology and a second set of pixels are dedicated to video.

15. A display driver comprising:

a microcontroller configured to receive, store and process symbol information and configuration information; and a one-bit symbology generator configured to accept the symbol information and configuration information, and produce therefrom a one-bit symbology stream.

16. The display driver of claim 15, further including an interface to a microdisplay, the interface being configured to operatively couple the one bit symbology generator to the microdisplay.

17. The display driver of claim 15, wherein the symbology generator includes a bit memory access module configured to set or clear a bit in a frame buffer within a single clock cycle.

18. The display driver of claim 15, wherein the symbology generator includes a caching module configured to accomplish a read from a cache or write to the cache.

19. The display driver of claim 15, wherein the symbology generator includes an address realignment module configured to accomplish a multiple-bit write of symbology information to a frame buffer memory.

20. The display driver of claim 15, wherein the symbology generator maintains an active set of symbology data in a frame buffer, and the symbology generator repeatedly scans the symbology data from the frame buffer to the microdisplay.

* * * * *